United States Patent [19]

Asai et al.

[11] Patent Number: 4,934,282

[45] Date of Patent: Jun. 19, 1990

[54] CIRCULATING TYPE FLUIDIZED BED COMBUSTION APPARATUS

[75] Inventors: Minoru Asai, Kamagaya; Yukio Oda, Matsudo; Kiyoshi Aoki, Chiba; Hiromi Shimoda, Hasuda; Keiji Makino, Kamakura, all of Japan

[73] Assignee: Ishikawajima-Harima Jukogyo Kabushiki Kaisha, Japan

[21] Appl. No.: 281,814

[22] Filed: Dec. 8, 1988

[30] Foreign Application Priority Data

Feb. 18, 1988 [JP] Japan ..... 63-35530

[51] Int. Cl.[5] ..... F23G 5/00

[52] U.S. Cl. ..... 110/244; 431/170

[58] Field of Search ..... 431/7, 170; 122/4 D; 432/14, 15, 58; 110/245, 263, 347, 244

[56] References Cited

U.S. PATENT DOCUMENTS

| | | | |
|---|---|---|---|
| 4,330,502 | 5/1982 | Engström | 431/170 X |
| 4,419,965 | 12/1983 | Garcia-Mallol et al. | 122/4 D |
| 4,445,844 | 5/1984 | Matthews | 431/170 X |
| 4,457,289 | 7/1984 | Korenberg | 122/4 D |
| 4,627,812 | 12/1986 | Kelly et al. | 431/7 |
| 4,655,147 | 4/1987 | Brännström et al. | 110/263 |
| 4,781,574 | 11/1988 | Taylor | 431/7 |

FOREIGN PATENT DOCUMENTS

| | | | |
|---|---|---|---|
| 61-240010 | 10/1986 | Japan . | |
| 206309 | 9/1987 | Japan | 431/170 |

*Primary Examiner*—Randall L. Green

[57] ABSTRACT

Distribution nozzles are arranged on an air distribution plate disposed at the lower portion of a furnace and spaced apart by a predetermined distance from the bottom thereof and one or more spouted nozzles extend upwardly from the air distribution plate so that not only a fluidized bed defined by the air discharged through the distribution nozzle but also one or more spouted beds defined by the air flows injected through the spouted nozzle or nozzles into the fluidized bed are formed within the furnace. Because of the coexistence of the fluidized bed and the spouted bed or beds, the agitated effect in the fluidized bed is enhanced and the combustion efficiency as well as the desulfurization can be pronounced. A particle feeding pipe is connected to the furnace to feed fuel and desulfurizing agent into the furnace. Secondary air from a secondary air supply pipe and portion of ash extracted through the bottom of the furnace by feed means are fed into the furnace at a position higher than the position of the opening of the particle feeding pipe into the furnace. A dust collector is disposed at a top of the furnace to circulate the ash trapped into the fluidized bed, whereby combustion efficiency as well as response to variations of load over a wide range can be ensured.

3 Claims, 2 Drawing Sheets

CIRCULATING TYPE FLUIDIZED BED COMBUSTION APPARATUS

BACKGROUND OF THE INVENTION

The present invention relates to a circulating type fluidized bed combustion apparatus used for burning solid fuel in boilers, incinerators and the like.

With the fluidized bed combustion apparatus, solid fuel can be burned at relatively low temperatures and therefore contents of nitrogen oxides contained in exhaust gases are less as compared with stationary combustion apparatus. Fluidized bed combustion apparatus are therefore widely used in boilers, incinerators and the like since desulfurization can be carried out in a fluidized bed and low-grade coal can be burned as fuel.

Fluidized bed combustion apparatus are, however, disadvantageous in that combustion proceeds mainly in a fluidized bed in the furnace and finely divided unburned particles are discharged out of the furnace. Moreover, although the desulfurization may be indeed carried out, a desulfurizing agent flows only in the fluidized bed and the desulfurization tends to be insufficient, resulting in a problem that the coefficient of utilization of the desulfurizing agent is still as low as $CaO/S \approx 4$.

In order to solve the above and other problems, there has been devised and demonstrated a circulating type fluidized bed combustion apparatus in which bed materials are forced to circulate and fuel is burned in a jet-like or injected bed in a furnace which is blown upwardly at a high velocity. Such circulating fluidized bed combustion apparatus affords not only circulation of the bed materials but also that of the unburned fuel and other particles such as desulfurizing agent so as to burn them again and therefore, as compared with the above-described noncirculating type fluidized bed combustion apparatus, the combustion efficiency is as high as 99% and the coefficient of utility of the desulfurizing agent used is as high as $CaO/S < 2$. In addition, discharged amount of the nitrogen oxides can be also decreased since the temperature distribution in the furnace can be more uniformly maintained and the local combustion temperature can be decreased to some extent.

However, in the case of such circulating type fluidized bed combustion apparatus with higher gas velocities, there arises the problem that furnace height must be considerably high so as to attain a predetermined resident time. Furthermore, response to variation of load is not satisfactory because the volume of circulating particles cannot be controlled.

In view of the above, a primary object of the present invention is to provide a high-performance circulating type fluidized bed combustion apparatus with improved combustion efficiency and capable of readily responding to load varied over a wide range.

The above and other objects, effects and features of the present invention will become more apparent from the following description of preferred embodiments thereof taken in conjunction with the accompanying drawings.

DETAILED DESCRIPTION OF THE PREFERRED EMBODIMENTS

Figure 1:
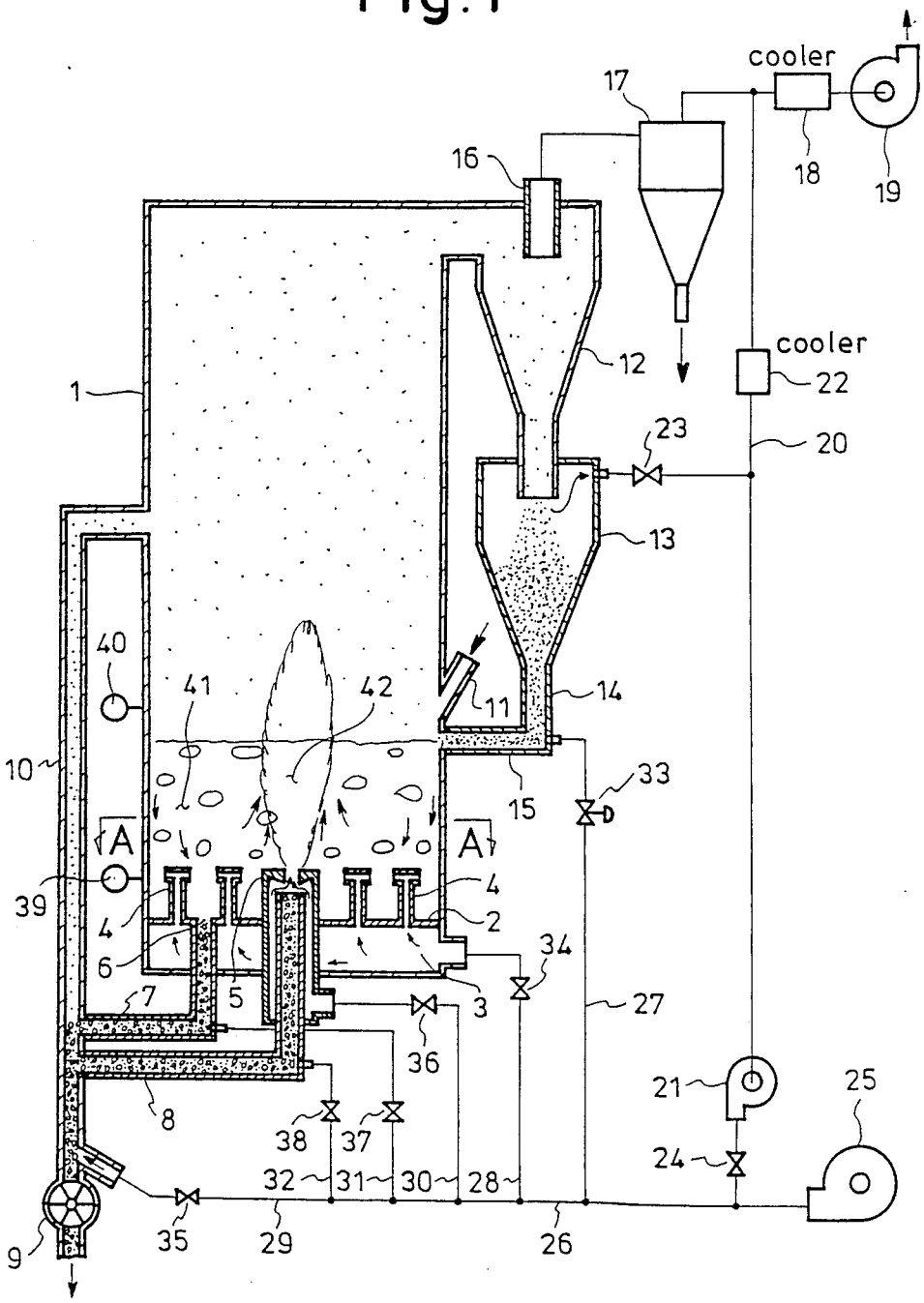
FIG. 1 is a schematic view of a first embodiment of a circulating type fluidized bed combustion apparatus in accordance with the present invention.
Figure 2:
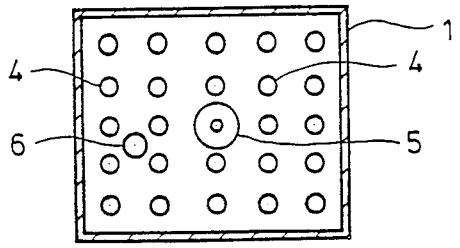
FIG. 2 is a sectional view taken along the line A-A in FIG. 1.

Referring first to FIGS. 1 and 2, an air distribution plate 2 is disposed within a furnace 1 at a predetermined position from the bottom thereof to define a wind box 3 together with the bottom of the furnace 1. A plurality of air distribution nozzles 4 each having horizontal opening extend from the distribution plate 2 in a preferred pattern. A spouted nozzle 5 extends upwardly at the center of the plate 2 which is further formed with an ash discharge port 6 in connection with an L-shaped valve 7. This L-shaped valve 7 and another L-shaped valve 8 which is inserted at its upper portion into the spouted nozzle 5 are communicated with a secondary air supply pipe 10 which is opened at its upper end to the furnace 1 at a position higher than the position of the opening of a fuel supply pipe 11 to be described below. The lower end of the pipe 10 is communicated with a rotary valve 9.

A first cyclone 12 is provided at the upper portion of the furance 1 and is communicated at its lower end with an ash storage 13. The storage 13 has a discharge port 14 with which a further L-shaped valve 15 is communicated. The valve 15 is opened into the furnace 1 at a position higher than the upper ends of the air distribution nozzles 4. The fuel supply pipe 11 is opened into the furnace 1 immediately above the opening of the valve 15.

A gas discharge port 16 at the top of the first cyclone 12 is cmmunicated at its gas discharge port through a cooler 18 with an exhaust fan 19. The upstream line of the cooler 18 is communicated through a circulation line 20 with a gas circulation fan 21. A cooler 22 is inserted into the gas circulation line 20 and a portion of the line 20 downstream of the cooler 22 is communicated through a valve 23 with the ash storage 13. The gas circulation fan 21 is communicated through a valve 24 with a main air supply pipe 26 which in turn is communicated with a blower 25.

The main air supply pipe 26 branches into a circulatng-ash-transporting air supply pipe 27, a primary air supply pipe 28, a secondary air supply pipe 29, an spouted air supply pipe 30 and bed-material-transporting air supply pipes 31 and 32. The air supply pipe 27 is communicated through a control valve 33 with the L-shaped valve 15; the primary air supply pipe 28 is communicated through a valve 34 with the wind box 3; the air supply pipe 30 is communicated through the valve 36 with the spouted nozzle 5; the air supply pipes 31 and 32 are communicated through valves 37 and 38 with the L-shaped valves 7 and 8, respectively; and the secondary air supply pipe 29 is communicated through a valve 35 with the secondary air supply pipe 10 at a position upstream of the rotary valve 9.

Pressure gauges 39 and 40 are installed on the furnace 1 and are vertically spaced apart from each other by a predetermined distance. In response to output signals from the pressure gauges 39 and 40, a control unit (not shown) controls the degree of opening of the control valve 33. Thus, the circulating fluidized bed combustion apparatus is provided.

Next, the mode of operation of the apparatus will be described.

The fuel and the desulfurizing agent are relatively thinly supplied over the surface of the air distribution plate 2 from the fuel supply pipe 11 and the valve 34 is opened at a predetermined degree. The primary air is blown from the air distribution nozzles 4 through the primary air supply pipe 28 and the wind box 3.

The air blown out of the air distribution nozzles 4 fluidizes the fuel ash and desulfurizing agent to form a fluidized bed 41 whereas the air through the air supply pipe 30 and the valve 36 is injected into the furnace 1 at a high velocity from the spouted nozzle 5. The latter air injected through the spouted nozzle 5 blows the fuel and the desulfurizing agent to circulate them, thereby defining a local spouted bed 42.

In the fluidized bed 41, the fuel is burned with a condition of sub-stoichiometry to reduction of nitrogen oxides. Because of the locally formed spouted bed 42, the fluidized bed 41 is agitated to attain satisfactory contact between the sulfur oxide with fuel burning and the desulfurizing agent, thereby promoting the desulfurization. Scattered ash particles containing unburned carbon particles, fine particles of combustion products and so on in the fluidized bed 41 are forced to move toward the spouted bed 42 and then trapped by the spouted air flow so that they are blown out of the fluidized bed 41, resulting in secondary combustion of such particles with the spouted air flow within the furnace 1. Sulfur oxide ($SO_0$) which still remains after the desulfurization in the fluidized bed 41 is further desulfurized under the condition of excess air from the secondary air supply pipe 10 above the fluidized bed 41 in the furnace. 1.

The ash particles scattered in the furnace 1 are separated by the first cyclone 12 disposed at the outlet port of the furnace 1 and then discharged into the ash storage 13. The ash particles stored in the storage 13 is charged into the fluidized bed 41 by way of the L-shaped valve 15 for recirculation of the ash particles.

The fine ash particles entrained in the exhaust gas discharged through the exhaust port 16 are separated and trapped by the second cyclone 17 and only the exhaust gas is discharged therefrom. The discharged gas is cooled by the cooler 18 and is blown out of the system by the exhaust fan 19.

Part of the exhaust gas is sucked through the cooler 22 by the gas circulation fan 21 and is mixed with the air supplied from the blower 25. This is done to control the content of oxygen in the air being supplied for control of the combustion condition in the furnace 1.

The coarse ash particles remaining in the fluidized bed 41 gradually drops into the L-shaped valve 7 and are mixed with the secondary air flowing through the secondary air feeding pipe 10 by the air from the bed-material transporting air supply pipe 31 and then are discharged out of the system by the rotary valve 9.

The content of the ash storage 13 is sucked by the gas circulation fan 21 through the valve 23 so that, of the ash particles stored in the ash storage 13, only unburned fine particles and the desulfurizing agent not fully used are sucked to mix with the air from the blower 25 and are recirculated into the furnace 1 together with the primary, secondary air or the air to be injected into the furnace 1, resulting in minimization of the leakage of the unburned fine particles and the like through the exhaust port 16. Furthermore, the secondary air is heated through heat exchange with the coarse ash particles while flowing upwardly through the secondary air feeding pipe 10, so that the fine particles contained in the rough ash particles are blown and returned into the furnace 1. As a result, the desulfurizing agent not fully used and the unburned fine particles can be positively and efficiently circulated and the remarkable increase of the combustion efficiency and the desulfurization effect can be ensured.

Thickness of the fluidized bed 42 can be measured based on the differential in pressure measured by the pressure gauges 39 and 40; in order to maintain the height of the fluidized bed 42 at a predetermined value or to vary it in response to load variation, the flow rate of the particles flowing through the L-shaped valve 15 and thus the degree of opening of the control valve 33 is adjusted to adjust the pressure difference for a desired height of the fluidized bed 42. It follows therefore that the ash storage 13 serves as damper for adjusting the quantity of the ash particles to be circulated.

The quantity of the particles to be supplied and circulated is controlled in this manner so that the required quantity of the circulating particles can be properly maintained even under partial loading and response to variation of load over a wide range is enhanced.

When the furnace of the type described above is to be used only as fluidized bed furnace, the valve 36 is completely closed to eliminate the injection of the air into the furnace 1. In such case of ceasing the injection of the air into the furnace, the L-shaped valve 8 serves as stop valve to prevent intrusion of the particles into the injection nozzle 5. The L-shaped valve 8 permits discharge of the ash particles by opening the valve 38.

Figure 3:
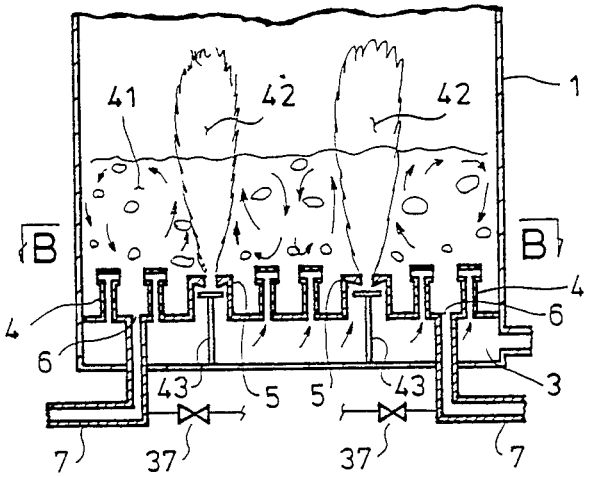
FIG. 3 is a schematic view of a second embodiment of the present invention.
Figure 4:
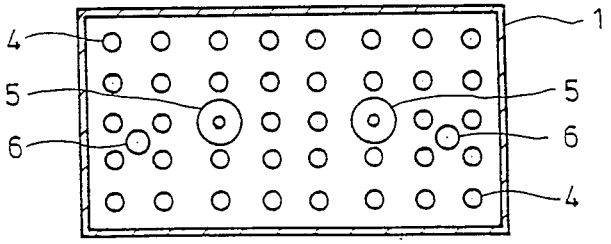
FIG. 4 is a sectional view taken along the line B-B in FIG. 3.

FIGS. 3 and 4 show a second preferred embodiment of the present invention in which a plurality of air injection nozzles 5 extend upwardly from the diffusion plate 2; stop valves 43 are used instead of the L-shaped valve 8; and the air is forced to be injected into the furnace 1 through the wind box 3. The mode of operation of the second embodiment with such construction is substantially similar to that of the first embodiment described above with reference to FIGS. 1 and 2 so that further description shall not be made in this specification.

It is to be understood that the present invention is not limited to the above-described embodiments and that various modifications may be effected within the true spirit of the present invention. For instance, the furnace may be in the form of a cylinder or a regular prism having a desired cross sectional configuration. Furthermore, depending upon the types of fuel, optimum positions are selected for supply of the fuel and desulfurizing agent and for re-introduction of the ash particles through the dust separator into the fluidized bed. So far in both of the first and second embodiments, the L-shaped valves are used as feeding means but any other suitable means such as screw feeders may be used.

As described above, the present invention can attain the following effects and features;

(i) Afforded is the condition that the quantity of air is insufficient in the fluidized bed while the quantity of air is in excess in the injected-flow bed so that the nitrogen oxides can be considerably reduced in quantity and a high degree of desulfurization can be ensured.

(ii) Satisfactory secondary combustion can be attained in the spouted bed so that the fluidized layer on the primary side within the fluidized bed can be decreased in thickness and the power requirement can be decreased.

(iii) The ash particles including desulfurizing agent not fully utilized yet are separated and returned into the furnace by the secondary air so that reduction in consumption of the desulfurizing agent and heat recovery as well as reduction of $NO_x$ produced can be attained.

(iv) Because of the combination of the fluidized bed with the spouted bed, the reaction time of the desulfurizing agent can be satisfactorily increased so that, as compared with the conventional circulating fluidized bed combustion apparatus, the furnace in accordance with the present invention can be decreased in height.

(v) Because of the combination of the fluidized bed with the spouted bed, the agitation within the fluidized bed can be enhanced so that the combustion efficiency as well as the desulfurization effect can be improved.

(vi) When the injected-flow bed is designed to be away from the walls of the furnace, the velocities of the particles along the furnace walls can be decreased and consequently wear of the furnace walls can be reduced to a minimum.

(vii) The circulating type fluidized bed combustion apparatus in accordance with the present invention incorporates therein means for controlling the quantity of the particles to be returned or circulated into the fluidized bed so that even under partial loading, required quantity of the circulating particles can be ensured and response to variations in load can be improved.

(viii) When the L-shaped valves are used as feeding means, control of the quantity of the circulated particles can be carried out only by air flows so that the combustion apparatus becomes simple in construction.

What is claimed is:

1. A circulating type fluidized bed combustion apparatus comprising an air distribution plate at a lower portion of a furnace body and spaced apart from a bottom thereof, a plurality of distribution nozzles extending upwardly from said air distribution plate for discharging primary air into the furnace body, thereby forming a fluidized bed therein, at least one injection nozzle extending from said distribution plate upwardly into said fluidized bed for upwardly injecting air flow for formation of at least one spouted bed within said fluidized bed, a particle supply pipe attached to said furnace body for feeding fuel and desulfurizing agent into said furnace body at a first position, means for removing a portion of ash in said furnace body from said bottom, and a secondary air feed pipe connected to said removing means for feeding secondary air and ash extracted by said removing means into said furnace body at a position higher than said first position, and dust collector means at a top of said furnace body for circulating trapped ash to said fluidized bed.

2. The apparatus according to claim 1 wherein said dust collector means is communicated with said furnace body through an ash storage, the ash stored in said ash storage being fed into said furnace body by further feed means.

3. The apparatus according to claim 2 wherein each of the feed means comprises a vertical pipe section and a horizontal pipe section joined together, air being fed through said horizontal pipe section.

* * * * *